United States Patent [19]

Bogart et al.

[11] Patent Number: 4,923,487

[45] Date of Patent: May 8, 1990

[54] CROSS FLOW DIESEL PARTICULATE TRAP

[75] Inventors: Douglas A. Bogart, Dayton; Robert C. Schenck, Jr., Kettering, both of Ohio

[73] Assignee: The Duriron Company, Inc., Dayton, Ohio

[21] Appl. No.: 258,968

[22] Filed: Oct. 17, 1988

[51] Int. Cl.[5] ..... F01N 3/02

[52] U.S. Cl. ..... 55/482; 55/484; 55/498; 55/523; 55/DIG. 30; 60/311

[58] Field of Search ..... 55/482, 484, 498, 523, 55/DIG. 30; 60/311

[56] References Cited

U.S. PATENT DOCUMENTS

| | | | |
|---|---|---|---|
| 2,951,551 | 9/1960 | West | 55/484 |
| 4,129,429 | 12/1978 | Humbert, Jr. et al. | 55/484 |
| 4,243,536 | 1/1981 | Prolss | 55/484 |
| 4,283,207 | 8/1981 | Martyniuk | 55/DIG. 30 |
| 4,293,357 | 10/1981 | Higuchi et al. | 55/523 |
| 4,359,864 | 11/1982 | Bailey | 60/311 |
| 4,416,675 | 11/1983 | Montierth | 55/523 |
| 4,417,908 | 11/1983 | Pitcher, Jr. | 55/523 |
| 4,419,113 | 12/1983 | Smith | 55/DIG. 30 |
| 4,427,423 | 1/1984 | Montierth | 55/484 |
| 4,436,538 | 3/1984 | Tomita et al. | 55/482 |
| 4,466,817 | 8/1984 | Faas et al. | 55/DIG. 30 |
| 4,504,294 | 3/1985 | Brighton | 55/523 |
| 4,535,588 | 8/1985 | Sato et al. | 60/311 |
| 4,604,869 | 8/1986 | Yoshida et al. | 60/311 |
| 4,686,827 | 8/1987 | Wade et al. | 55/DIG. 30 |
| 4,704,863 | 11/1987 | Abthoff et al. | 60/311 |

FOREIGN PATENT DOCUMENTS

| | | | |
|---|---|---|---|
| 1193206 | 9/1985 | Canada | 55/523 |
| 2446121 | 9/1980 | France | 55/498 |
| 56-92318 | 7/1981 | Japan | 55/DIG. 30 |
| 57-79210 | 5/1982 | Japan | 60/311 |
| 71803 | 3/1947 | Norway | 55/484 |

*Primary Examiner*—Jay H. Woo
*Assistant Examiner*—C. Scott Bushey
*Attorney, Agent, or Firm*—Biebel, French & Nauman

[57] ABSTRACT

Cross flow diesel particulate traps are disclosed in which a cylindrical canister contains a plurality of individual ceramic trap elements. The canister is provided with inlet openings along one side and outlet openings along another side which respectively communicate with inlet and outlet spaces formed between individual ceramic trap elements. The traps are provided with inlet and outlet plenums which communicate with the respective canister openings for directing exhaust gases through the canister and for collecting the exhaust gases. In one embodiment, the inlet plenum is divided by partitions into zones and a diverter valve directs regeneration gases to selected zones canister regeneration. Ceramic trap elements are disclosed adapted for use in a diesel exhaust gas particulate trap formed with a disc-shaped body of open cell ceramic material with opposite faces terminated by partially surrounding peripheral walls which define inlet and outlet gaps at the respective sides of the element. A membrane layer having a pore size substantially smaller than that of the remainder of the body is formed at the outlet surface of the trap element.

21 Claims, 4 Drawing Sheets

INLET PLENUM
OUTLET PLENUM
20
22
25
26
30
31
75
3
4
5

CROSS FLOW DIESEL PARTICULATE TRAP

BACKGROUND OF THE INVENTION

This invention relates to diesel exhaust particulate traps, and more particularly to a side entry or cross-flow trap employing a plurality of trap elements and to the ceramic trap elements themselves.

Particulate traps designed to fulfill the requirements of diesel engines necessarily are required to meet a number of conflicting parameters. It is important that the trap elements have a sufficiently small pore size for the effective trapping of the diesel exhaust particulates, and at the same time present a low pressure so that the trap does not material exceed the back pressure of a conventional muffler. Further, the trap elements must possess a substantial filtering surface or capture volume, so that the entire trap can be fabricated within an envelope which does not substantially exceed that of a conventional muffler. Also, the trap must be susceptible to ease of regeneration.

Diesel particulates traps for filtering and trapping particulate material, such as a soot, from the exhaust of diesel engines, have generally been constructed as a monolithic honeycomb. Such traps commonly have a multitude of internal parallel chambers separated by thin porous internal membranes or walls. Part of such chambers are dead-ended or end sealed, to force the exhaust gas to traverse across the porous wall before exiting.

Trap regeneration typically is accomplished by heating the trap to a temperature sufficiently high to burn off the entrapped particles. While regeneration is taking place, it is usually necessary to bypass the trap, or to provide a second parallel connected trap for use during regeneration.

The component parts making up the trap, including the operative internal portions, must be sufficiently rugged to withstand use, and even abuse, over a long service life. The trapping material and the trap elements made of such material must be able to withstand mechanical and thermal shocks, and must be adequately protected or isolated from excessive shock, to provide the required life.

U.S. Pat. No. 4,871,495 of Helferich and Schenck, issued Oct. 3, 1989 and assigned to the same assignee as this invention, incorporated herein by reference, describes and claims a ceramic trap composition which is capable of being molded, such as by casting, injection molding, or extrusion, into a wide variety of shapes and configurations. The composition provides a ceramic trap material which has a predominantly open celled porosity. This material has significant advantages in an ability to manipulate the cell size and mass, as to provide a wide variety of characteristics in the final article. The moldable composition, after processing and firing, forms a ceramic microstructure characterized by low thermal expansion, and high thermal shock resistance with suitable refractoriness.

A further characteristic of the product and composition as described in the above-identified copending application resides in an ability to form, on one or more exposed surfaces, a "membrane" layer having a pore size which is substantiallY smaller than the pore size of the remaining body of the material. The membrane surface forms a final trap or filter when the material is used as an element in a trapping system. The product and composition as disclosed in the above mentioned Helferich et al patent have particular advantage when used as trapping elements in a trap containing a plurality of such elements arranged in parallel to each other with respect to the direction of exhaust gas flow. Therefore this product is particularly adapted for use in the elements of the side entry diesel particulate trap as described herein.

SUMMARY OF THE INVENTION

This invention relates to a side entry diesel particulate trap in which a plurality of individual ceramic trap or filtering elements, preferably made, of material according to the Helferich et al Pat. No. 4,871,495, are mounted or carried in a canister. The elements are arranged in the canister so that a plurality of the elements are in parallel to the direction of flow of the exhaust gases through the trap.

In a preferred embodiment of the invention, a canister contains a plurality of individual disc-like ceramic trapping elements stacked one on top of the other. The canister side wall has axially spaced inlet openings along one side thereof and outlet openings axially spaced along the opposite side of the canister. These side wall openings respectively communicate with inlet and outlet openings formed by and between the stacked ceramic elements in the canister.

The ceramic elements have a disc-like shape, and most of the elements have a central body portion which defines an inlet surface, on one side, and an outlet surface on the other side. The elements are stacked in the canister so that pairs of inlet surfaces face each other in spaced-apart relation defining inlet cavities or spaces and alternating pairs of such outlet surfaces are in facing spaced relation forming outlet spaces between adjoining element pairs. As previously noted, when the disc-like elements are arranged in a stack in the canister, they form inlet openings which communicated with the canister inlets and outlet spacings which communicate with the canister outlets.

The ceramic trap elements of the invention are formed with a central body surrounded by a partial peripheral wall. The wall on one side of the body is discontinuous in that it is formed with a partial opening or space which mates with the partial opening of an adjacent element to form a full inlet opening between the element pair, to admit exhaust gases into the space between the central body portions. Similarly, the peripheral wall forms a partial outlet opening on the opposite side of the element diametrically opposite the partial inlet opening. The outlet opening cooperates or mates with the corresponding partial opening on a superimposed or adjacent disc to define a common outlet between outlet surfaces of the disc bodies. The inlets and outlets thus formed communicate with corresponding inlet and outlet openings of an enclosing canister.

The individual trap elements are held in compression, in the canister, and are cushioned by pads of intumescent material. This material is positioned between the elements and the canister wall and between the individual elements.

The trap also has inlet and outlet plenums. These are formed on or are attached to the canister. The plenums join respectively with the inlet and outlet openings of the canister, for delivery of the exhaust gases to the trap and for collection of gases from the trap.

In another preferred embodiment of the invention, an inlet plenum is provided with a plurality of internal partitions. These partitions direct the exhaust gas flow to selected ones of the canister inlet openings. A diverter valve is operable to select one zone at a time of the inlet plenum passageways for regeneration, while the exhaust gas continues to flow through the remainder of the canister not undergoing regeneration. By operating the diverter valve from zone to zone, the entire canister may be regenerated online and without interrupting the trapping of particulates.

The modular design of the trap in accordance with this invention provides certain advantages over previous monolithic designs. For example, the modular design permits the system to be easily enlarged so as to handle the exhaust of engines of higher horsepower or displacement, by the addition of trap elements to the design of the canister. In other words, the disc-like trap elements, in accordance with this invention, may be advantageously used to build up a wide variety of traps of different capacities, as may be desired, by providing canisters which have a fewer or greater number of such elements.

The employment of layers of intumescent material between the individual trap elements, and between the peripheral portions of the elements and the walls of the canister, provide a trap which is highly immune to mechanical stresses. The entire trap accordingly possesses greater flexibility as compared to equivalent capacity designs in the monolithic form.

The risk of thermal shock damage to the trap elements is reduced by controlling the thermal gradients across the entire trap or canister during regeneration. Since the trap itself includes a plurality of individual elements, and since these elements may be divided into zones for regeneration, in which the zones are isolated from each other, and since the trap elements are protected by intumescent material, the risk of thermal shock damage to the canister is reduced, by controlling the thermal gradients which occur across the trap during regeneration.

It is accordingly an important object of this invention to provide a cross-flow trap in which a plurality of individual ceramic particulate trap elements are mounted in generally parallel rotation to each other with respect to the flow of exhaust gases.

A further object of the invention is the provision of a trap, as outlined above, in which individual pairs of disc-like trap elements in a canister have facing inlet surfaces and facing outlet surfaces, with means in the canister by which exhaust gases are directed to the inlet surfaces for flow through the element body to the outlet surfaces.

A further object of the invention is the provision of a particulate trap employing a canister having a plurality of individual ceramic trap elements therein, and in which selected zones of the canister may be regenerated on line.

Another object of the invention is the provision of a particulate trap and diverter valve combination, and a diverter valve therefor, for selecting zones of the trap for sequential regeneration.

A still further object of the invention is the provision of diesel particulate trap elements made according to the teachings of the above-identified U.S. Pat. No. 4,871,495.

These and other objects and advantages of the invention will be apparent from the following description, the accompanying drawings, and the appended claims.

DETAILED DESCRIPTION OF PREFERRED EMBODIMENTS

Figures 1, 2, 3, 4, 5:
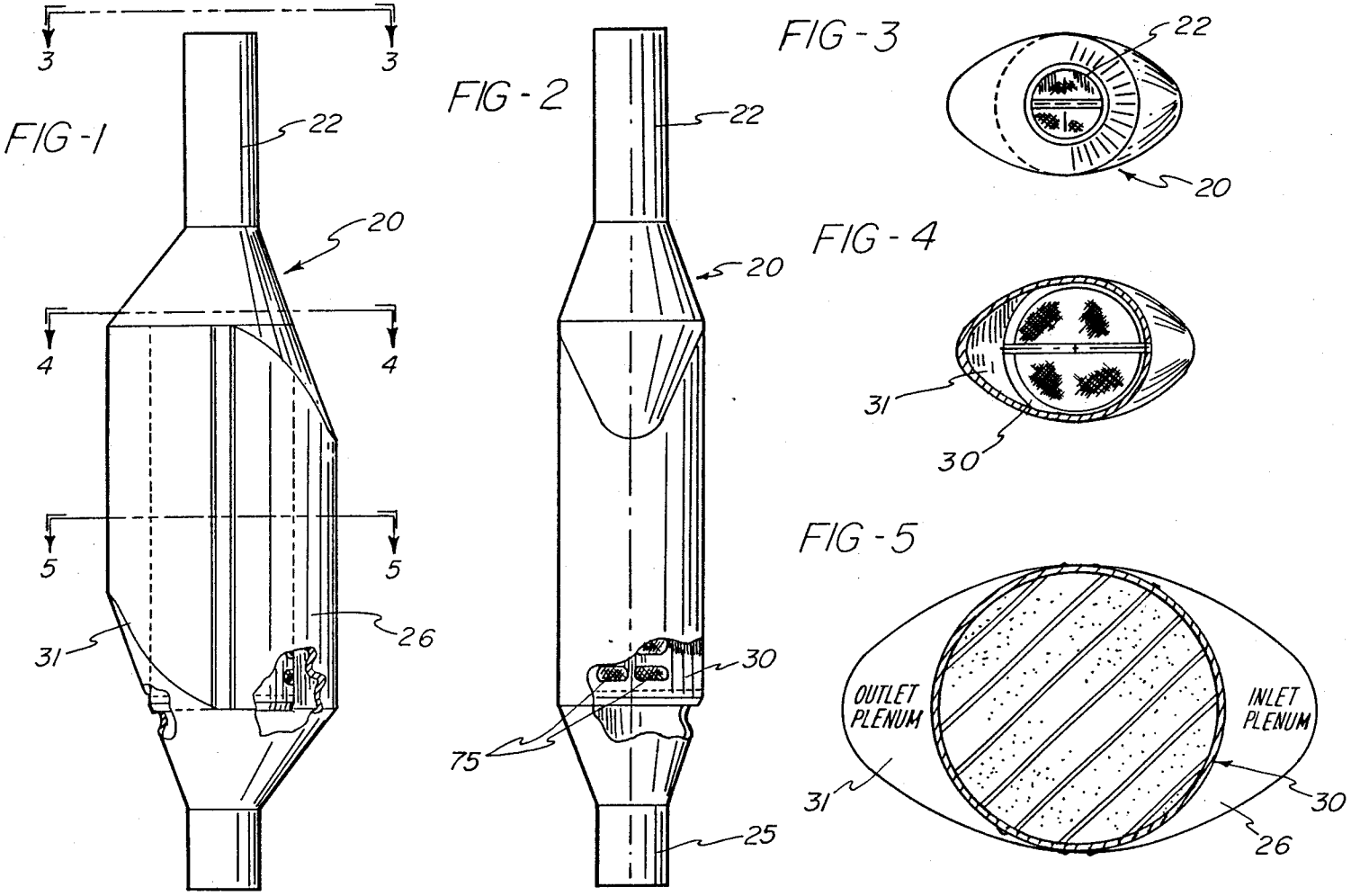
FIG. 1 is an elevational view of a trap made according to this invention, with portions of the plenums broken away at the inlet end showing the canister therein.
FIG. 2 is another side elevation of the trap of FIG. 1. showing the trap rotated through 90°, with a portion of the inlet plenum broken away to reveal a fragment of the canister.
FIG. 3 is an end view of the trap looking generally along the view line 3—3 of FIG. 1.
FIG. 4 is a transverse section through the outlet end, taken generally the line 4—4 of FIG. 1.
FIG. 5 is another transverse section looking generally along the line 5—5 of FIG. 1 and showing one of the trap elements in section.
Figure 13:
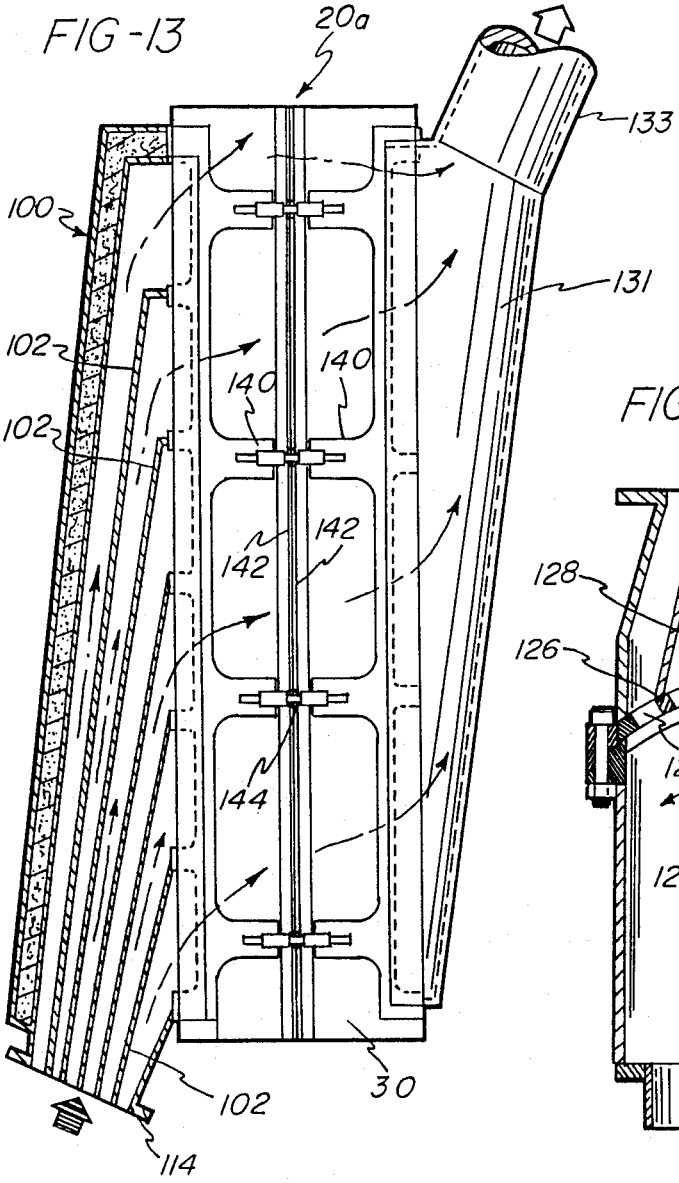
FIG. 13 is an elevational view, partially in section, of a modified form of the invention showing a partitioned inlet plenum forming regeneration zones.

Referring to the figures of the drawings, which illustrate preferred embodiments of the invention, a cross flow diesel particulate trap in accordance with one embodiment of this invention is illustrated generally at 20 in FIGS. 1 and 2. The trap 20 has an axially extending outlet pipe 22 at one end and a coaxial inlet pipe 25 at the other end. The pipes 22 and 25 may be typically of 5' diameter when the trap 22 is intended to be used on a relatively large truck engine. The trap may, in such instances, take the place of the conventional muffler. The trap 20 includes a side entry inlet plenum 26 which communicates with the inlet pipe 25 and extends along one side of an internal cylindrical canister 30. An outlet plenum 31 is positioned in diametrically opposed relation to the inlet plenum 26 along the opposite side of the canister 30 and communicates with the exhaust pipe 22 at one end of the canister. The inlet and outlet plenums may be joined to each other along axial sides so as to fully enclose or encase the canister, or may be joined by welding to the canister or joined by connectors as shown in the embodiment of FIG. 13.

Figure 6:
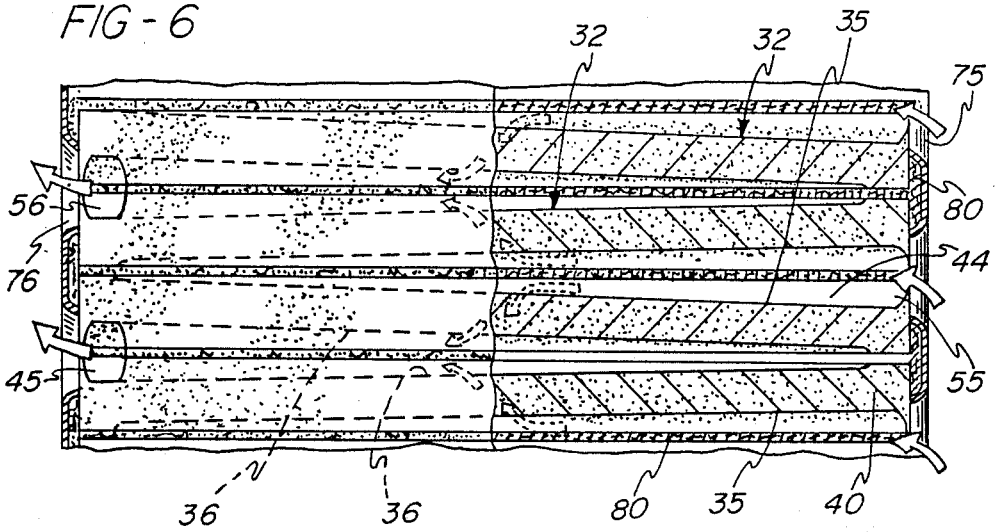
FIG. 6 is an enlarged fragmentary sectional view through a portion of the canister showing the stacked arrangement of the trap elements therein in relation to the canister inlet and outlet openings.
Figure 7:
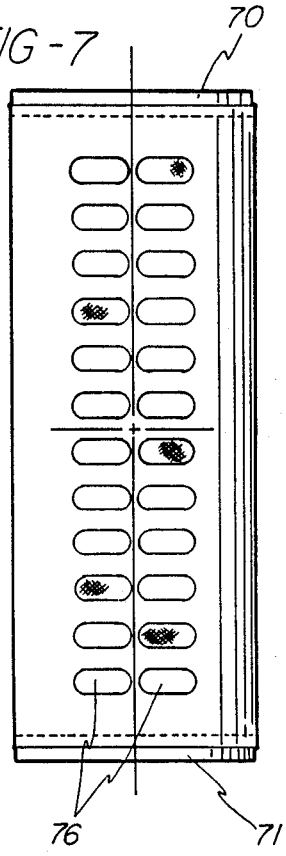
FIG. 7 is an elevational view of the canister.
Figure 8:
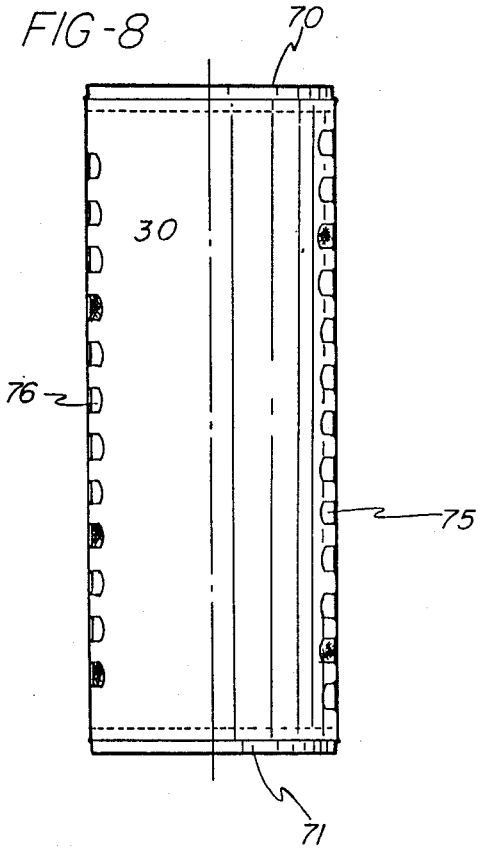
FIG. 8 is another elevational view of the canister at 90° to the view of FIG. 7.
Figure 10:
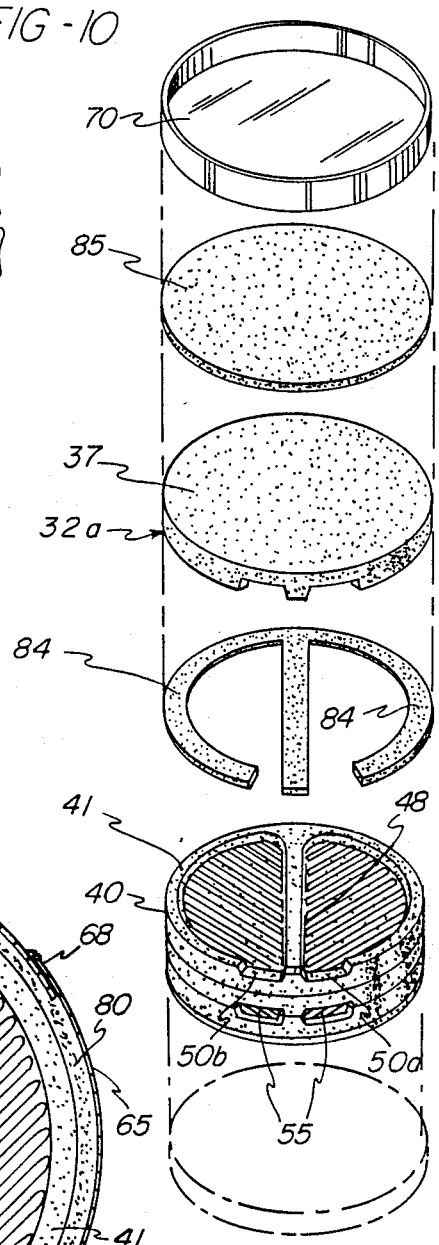
FIG. 10 is an exploded view showing the relationship of the trap elements within the canister and the intumescent separating membranes or gaskets.

The canister 30 is illustrated in FIGS. 6 through 8 as containing a plurality of individual foamed open cell ceramic filtering or trap elements 32. The elements 32 are made of a composition in accordance with the teachings of the above-identified Helferich U.S. Pat. No. 4,871,495. The elements 32 are positioned in stacked relation within the canister, as illustrated in FIGS. 6 and 10, and are preferably shaped in the form of circular discs. Although the canister 30 is shown in the form of a cylinder, it will be understood that other shapes may be made under the invention in accordance with the desired shape of the individual elements.

The elements 32 each have an inlet surface 35 formed on one side, an outlet surface 36 formed on the other side. The disc elements are stacked within the canister so that pairs of the inlet surfaces 35 face each other in spaced-apart relation, and likewise, pairs of outlet surfaces 36 face each other in spaced-apart relation. The trap elements 32 are identical except for the top and bottom elements 32*a* which may be formed with an outer blank or fat face 37.

Each disc element is formed with a partially surrounding peripheral wall 40 which extends axially above the adjacent inlet or outlet surface. The wall 40 defines radially flat load bearing surfaces 41 at the upper and lower mating edges of the wall. These wall surfaces are positioned in opposed relation to corresponding wall surfaces of adjacent disc elements 32, when stacked as described above.

Figure 12:
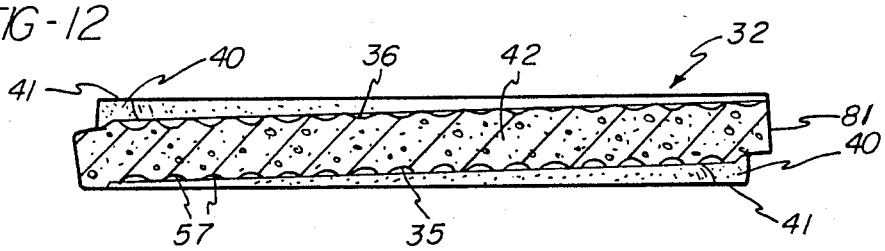
FIG. 12 is a transverse sectional view through one of the disc elements along the line 12—12 of FIG. 11.

The walls 40 extend axially of the disc by an amount which exceeds the thickness of the disc body 42 between the inlet and outlet surfaces, as illustrated in FIG. 12. When the elements 32 are stacked one on top of the other in the canister, the surfaces 35 or 36 of one of the elements is spaced from the corresponding facing surface of the immediately adjacent element on either side. In this manner, a disc inlet space 44 is formed between the pair of facing inlet surfaces 35, and a disc outlet space 45 is formed between each pair of facing outlet surfaces 36.

The inlet and outlet surfaces 35, 36 are divided by a central transversely or diametrically extending rib 48 formed on each side of each element and terminating at spaces or gaps 50 in the wall 40. The surface of the rib 48, at either side, is in the same plane as that of the surfaces 41 of the wall 40, and adds mechanical strength to the element 32.

Each gap 50 is divided by the rib 48 into sections 50*a* and 50*b*. When these gap sections are mated with corresponding gap sections of an adjacent element, pairs of adjacent inlets 55 and outlets 56 are formed. Since the wall gap on the inlet side of the disc element is diametrically opposite the gap formed on the outlet side, the inlets 55 are formed along one side of the disc stack and the outlets 56 are formed along an opposite side of the stack. A pair of the inlets 55 are shown in FIG. 10, while FIG. 6 shows a sectional view through one of the inlets 55 and an elevational view of the outlets 56. The inlets 55 communicate with the inlet spaces 44 between elements 30 while the outlets 56 communicate with the common outlet space 45 between elements.

Figure 11:
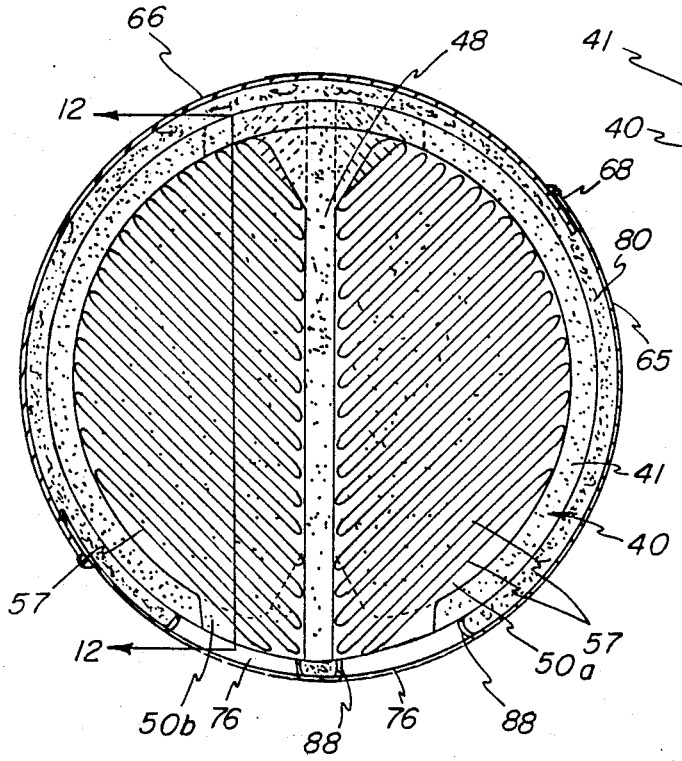
FIG. 11 is an enlarged sectional view through the canister with one of the trap elements shown in plan view therein.

Preferably, the inlet and outlet surfaces are generally parallel to each other, although the surfaces may be ribbed or corrugated as illustrated at 57 in FIGS. 11 and 12, in order to increase their effective areas. The corrugations 57 may be oriented in such a manner as to intercept gases at the inlet gaps 50*a* and 50*b* and spread the same over the inlet surface as shown in FIG. 11. The outlet surface 36 is formed in the same ribbed pattern as that of the inlet surface 35, except that the outlet surface pattern is rotated 180° with respect to the inlet surface or, in other words, is "head-to-toe" to the pattern formed on the inlet surface.

The inlet and outlet surfaces are inclined at about 2° to the transverse axis of the disc element 32 as defined by the plane of the load-bearing surfaces 41, to provide inlet and outlet spaces which taper through an included angle of about 4° with the wider end thereof terminating at the inlets or outlets, as defined above. The taper which is provided to the respective inlet spaces 44 and outlet spaces 45 tends to distribute the gas flow therethrough, and provides a more compact package.

Figure 9:
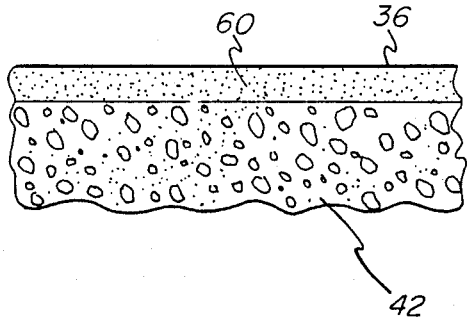
FIG. 9 is an enlarged fragmentary section through the body of one of the elements, showing the membrane layer.

As illustrated in FIG. 9, the body 42 of the element 32 is formed with a layer or membrane 60 which defines the outlet surface 36. The membrane layer 60 is shown in exaggerated thickness, and presents to the body 42 a pore size which is substantially smaller than that of the remainder of the body and acts as a final filter or trap, in the manner described in the above-identified Helferich et al application.

The body 42 may have a pore density of approximately 30–80 pores per linear inch and a pore size of between approximately 100–200 microns. The "membrane" layer 60 defining the outlet surface 36 may have a pore size in the order of less than 50 microns and a thickness in the order of about 50 microns. The membrane layer is believed materially to reduce the "blow-off" problem which has been encountered in conventional ceramic "filters" formed of reticulated foams.

As an example of one of the elements 32, and in no way intending to limit the scope of the invention, individual elements were made with an outside diameter of approximately 10'. The average spacing between the inlet and outlet surfaces, that is the average thickness of the body axially between these surfaces, was in the order of 0.50 inches. The inlet and outlet surfaces, exclusive of the corrugations, provided an effective area of approximately 65 square inches. The overall thickness of the disc element, as measured at the rims 48, was approximately 15/16'.

The canister 30 is formed with a pair of semicylindrical sides 65 and 66 as shown in FIG. 11, the edges of which are joined by axially extending welds 68. The top and bottom of the canister 30 are closed by end caps 70 and 71 as shown in FIGS. 7, 8 and 10. The disc elements 32 may be identical with the exception that the top and bottom elements 32*a* which may be formed with flat non-operative faces 37 positioned toward the respective end caps 70 or 71.

The canister walls or sides 65 and 66 are formed with diametrically opposed rows of inlet and outlet openings which align with the corresponding inlets and outlets formed by the disc element stack. For this purpose, the canister is provided with adjacent pairs of inlet openings 75 which register with the corresponding stack inlets 55. The canister walls also form adjacent pairs of outlet openings 76 which register with the trap element outlets 56.

Means for isolating the individual elements 32 from each other and from the canister walls, and for mounting the elements in compression include layers or pads of intumescent material. This material is shown at 80 in FIGS. 6 and 11, and is formed in surrounding relation to the outer cYlindrical surface 81 of each of the elements. The material 80 is also fashioned in the form of a gasket 84, FIG. 10, and positioned axially between the abutting or facing surfaces 41 and ribs 48 of the elements. A sheet 85 of the material 80 is also placed between each end cap 70 and 71 and the abutting surface 37 of the immediately adjacent element 32*a*.

The intumescent material 80 may be an expanded sheet of vermiculite and an alumina silicate fiber filler, as sold by 3M Company under the trade name "Interam." This material is manufactured with a polymeric binder material which is burned off when the mat reaches 300° C. and serves no further function The intumescent quality is accomplished by the swelling of the vermiculite material when heated above 300° C. Preferably, series III or IV style 3100, "Interam" surrounds the elements 32 between the outer surfaces 81 of the elements and the inside surfaces of the side walls 65 and 66. This material has an initial thickness of 15/64' compressed to 0.135'. The gaskets 84 may be made of series IV, style 2100 "Interam" with an initial thickness of 9/64' compressed to 0.093' thickness. In this manner, the individual ceramic disc elements 32 are cushioned and held in circumferential and axial compression in the canister 30.

The pairs of canister inlet openings 75 and outlet openings 76 are defined by inwardly-turned metal edges or lips 88, as best shown in FIG. 11. The lips 88 close and protect the otherwise exposed edges of the "Interam" material 80 from erosion at the inlets and outlets.

Figure 14:
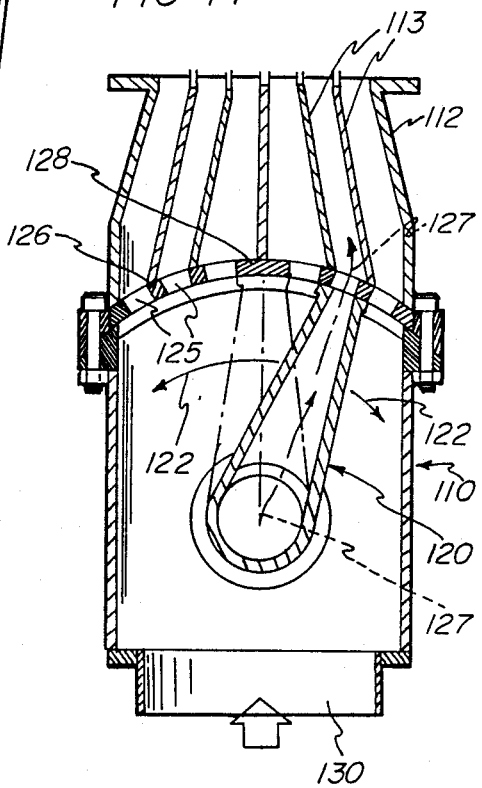
FIG. 14 is a sectional view of a selector or diverter valve of this invention for use with the embodiment of FIG. 13.

FIGS. 13 and 14 illustrate another preferred embodiment of a side entry trap 20*a* in which an inlet plenum 100 is especially adapted for selective regeneration of the elements in the canister 30. The inlet plenum 100 is provided with a plurality of internal baffles 102 which divide the pairs of inlet openings 75 into selectable axially spaced groups or zones, thereby isolating portions of the disc stack from other portions, for regeneration. Thus, in the embodiment as shown in FIG. 13 in which there are 18 pairs of inlet openings 75, five internal baffles 102 form six plenums which communicate with three pairs of the openings 75 for regeneration, while the remaining openings remain on line for trapping during regeneration.

A diverter for selectively directing regeneration gases from a burner (not shown) is illustrated at 110 in FIG. 14. The diverter 110 includes an adapter 112 and a plurality of internal partitions 113. The adapter 112 is proportioned to be mounted on the inlet end 114 of the plenum 100, and the partitions 113 each respectively align themselves with one of the baffles 102.

An internal diverter nozzle 120 is mounted for rotation in the direction of the arrows 122 to direct hot gases from a regeneration burner through selected ones of openings 125 in a curved wall 126, as shown by the arrows 127. The wall 126 is formed with a central blank portion 128 at which the nozzle 120 may be parked or stored, as shown in phantom view, when not in use. The exhaust gases enter a diverter inlet 130 and flow around the diverter nozzle 120 into the inlet plenum 100. When in use, the diverter nozzle 120 may be moved or rotated in the direction of the arrows 122 to align with particular ones of the openings 125 for selective regeneration of the disc elements 32 in the canister 30, corresponding to the selected zone.

The embodiment of the trap 20*a* of FIG. 13 illustrates another arrangement by which inlet and outlet plenums may be associated with a canister 30 to form a crossflow trap. As illustrated in FIG. 13, the inlet 114 of this embodiment is not formed on the axis of the canister, but rather is offset from the axis. Similarly, an outlet plenum 131 may be formed for gathering the exhaust gases from the canister outlet 76, with a common exhaust outlet 133 offset from the axis of the canister. The inlet and outlet plenums may be formed with partially encircling straps 140 terminated at mutually engaging flanges 142 and suitably strapped or connected together by tie bolts 144. When it is desired to remove the canister 30 it is only necessary to remove the tie bolts and separate the inlet and outlet plenums from the body of the canister.

Operation of the embodiment of the invention is largely self-evident from the foregoing description. The exhaust gases from a diesel engine will enter the inlet pipe 25 of the embodiment of FIGS. 1 and 2 or the inlet 130 of the diverter valve 110 of the embodiment of FIGS. 13 and 14, and will flow through the respective inlet plenum into the canister inlet openings 75, for flow into the inlet spaces 44 defined between pairs of the disc elements. The flow will then divide, as shown by the arrows in FIG. 6, and pass through the bodies 42 and the associated membrane 60, at the outlet surfaces 36. The particulates, such as soot and the like, are effectively trapped in the interstices formed within the ceramic elements 32 while the gases exit into the exit spaces 45 and out of the outlet openings 76 for flow into the outlet plenum 31 or 131.

In the embodiment of FIGS. 13 and 4, when regeneration is considered desirable or necessary due to a sufficient filling of the trap elements and an increase in the permissible back pressure, a burner is caused to direct heated gases through the diverter nozzle 120 and into one of the passages defined between the baffles 102. In this manner, a zone or portion of the disc elements may be elevated in temperature for purging and regeneration, in the order of 800 to 1,200° F. for about ten minutes, sufficient to cause a burning off of the entrapped particles. The diverter 120 may then be moved to another position, and so forth, until the canister is fully regenerated. Then, the nozzle may be parked at its central position at the wall 126.

The non-zoned trap 20 is also regenerated by a burner. During regeneration, the exhaust gases are diverted to a second trap or to a muffler.

While the forms of apparatus herein described constitute preferred embodiments of this invention, it is to be understood that the invention is not limited to these precise forms of apparatus, and that changes maY be made therein without departing from the scope of the invention which is defined in the appended claims.

What is claimed is:

1. A side entry cross flow trap for diesel particulates, comprising a canister having means defining an enclosing side wall, means closing said side wall at the ends thereof, a plurality of porous ceramic disc-shaped trap elements in said canister, said elements each having an inlet surface on one side thereof and an outlet surface on the opposite side thereof, means mounting a plurality of said elements in said canister with the inlet surface of one said element in opposed spaced relation to the adjacent inlet surface of an adjacent said element and with the outlet surface of one element opposed to the outlet surface of an adjacent said element defining inlet spaces between opposed pairs of said elements and outlet spaces between opposed alternating pairs of said elements, each of said elements having a peripheral wall partially surrounding each of said inlet and outlet surfaces and forming a gap aligned with corresponding said gaps in the walls of immediately adjacent said elements to form common peripheral inlets and outlets opening into said inlet and outlet spaces respectively, means in said canister side wall forming inlet openings aligned with said common inlets communicating with said inlet spaces and outlet openings aligned with said common outlets communicating with said outlet spaces, and plenum means on said canister for directing exhaust gases to said canister inlets and for receiving gases from said canister outlets.

2. The trap of claim 1 in which said canister is cylindrical and in which said elements are formed with cylindrical outer surfaces, and intumescent means between said canister walls and said elements and between adjacent said elements retaining said elements in compression.

3. The trap of claim 1 in which said element inlet and outlet surfaces are corrugated.

4. The trap of claim 1 in which said inlet and outlet surfaces of said elements are generally parallel to each other, and in which said surfaces are inclined to form said inlet and outlet spaces which are transversely tapered with the widest portions thereof at said gaps.

5. The trap of claim 1 in which said plenum means includes canister inlet plenum having a plurality of partitions forming discrete spaces therebetween leading to selected ones of said canister inlet openings thereby defining regeneration zones, and means for selectively applying heated gas to said spaces for zone-by-zone regeneration of said elements.

6. A side entry cross flow trap for diesel exhaust particulates, comprising a canister having a general cylindrical side wall closed by end caps at the ends thereof, a plurality of stacked porous ceramic generally disc-shaped trap elements received in said canister, said elements each having an inlet surface on one side thereof and an outlet surface on the other side thereof in spaced relation to said inlet surface, each said element side having a partially encircling rim formed at the periphery thereof, said rims having exposed surfaces confronting corresponding rim surfaces of an adjacent stacked element, each said rim defining a peripheral gap forming a partial opening so that when two of said elements are stacked one on the other, the partial openings mate to form a full opening, said elements arranged in said stack to present full openings in alternate alignment at the opposite sides of said stack thereby defining a plurality of peripheral stack inlets leading between pairs of said elements, and a plurality of peripheral outlets leading from one of said elements of said pair and a next adjacent element, said canister side wall having inlet and outlet openings therethrough in substantial alignment with respective said inlets and outlets, and plenum means on said canister for directing diesel exhaust gases to said inlet openings for cross flow through said canister and for collecting said gas at said outlet openings.

7. A side entry cross flow ceramic diesel particulate trap, comprising:

a canister having a metal sheet and containing a plurality of porous ceramic filtering elements, each of said elements having the general shape of a disc and defining an inlet surface on one side thereof and an outlet surface on the opposite side thereof, each of said elements having a partially surrounding peripheral wall defining upper and lower edges which mate with corresponding edges of another of said elements when stacked one on top of the other, said walls extending axially of said elements by an amount which exceeds the thickness between said inlet and outlet surfaces, so that when said elements are stacked, the facing surface of one element is spaced from the corresponding facing surface of the adjacent element, means in said wall defining a peripheral gap alignable with corresponding said gaps in superimposed said elements to form partial inlet and outlet side openings, a plurality of said elements stacked in alternating manner with pairs of said gaps aligned on opposite sides, defining peripheral gas inlets on one side of said stack and gas outlets on the opposite side of said stack, said canister having a cylindrical enclosing wall received about the elements in said stack, means in said canister wall forming canister inlet openings aligned with said stack inlets and outlet openings aligned with said stack outlets, end caps at each end of said enclosing wall, first plenum means on said canister joining said canister inlet openings and receiving diesel exhaust, and second plenum means on said canister joining said canister outlet openings and directing exhaust gases therefrom.

8. The trap of claim 7 further comprising a layer of high-temperature intumescent material between said elements in said stack and between said stack and said canister wall, and a layer of such intumescent material between each said end caps and the adjacent said element, said material being partially compressed in thickness to hold said elements in circumferential and axial compression.

9. The trap of claim 7 in which each said element is formed with membrane layer on said outlet surface, said membrane layer having a pore size substantially smaller that the pore size of the remainder of said element.

10. A cross flow canister for a side entry trap for diesel exhaust particulates, comprising:

a canister having a generally cylindrical side wall closed by end caps at the ends thereof, a plurality of stacked porous ceramic disc-shaped filter elements received in said canister, said elements each having an inlet surface on one side thereof and an outlet surface on the other side thereof in spaced relation to said inlet surface, each said element side having a partially encircling rim formed at the periphery thereof, said rims having exposed surfaces confronting corresponding rim surfaces of an adjacent stacked element, each said rim defining a peripheral gap forming a partial opening so that when two of said elements are stacked one on the other, the partial openings mate to form a full opening, said elements arranged in said stack to prevent full openings in alternate alignment at the opposite sides of said stack thereby defining a plurality of stack inlet openings leading between pairs of said elements, and a plurality of outlet openings leading from one of the elements of said pair and a next adjacent element, a pad of high temperature resistant intumescent material separating each said element in said stack of elements at said rim surfaces, a layer of said intumescent material interposed between said canister wall and said stack, said canister wall and end caps maintaining said intumescent material in partial compression to hold said elements in compression, said canister wall having inlet and outlet openings therethrough in substantial alignment with corresponding said openings in said stack of elements.

11. In a diesel particulate trap for removing carbon particulates from diesel exhaust gas, the improvement comprising a trap canister having a generally cylindrical side wall and enclosing end walls, a plurality of generally disc-like porous ceramic trap elements stacked in said canister one on top of the other and having surfaces in spaced apart relation defining gas inlet spaces between pairs of said elements and gas outlet spaces between alternating pairs of said elements, inlet means in said side wall for directing exhaust gas into said inlet spaces, and outlet means in said side wall for receiving gas from said outlet spaces, intumescent pad means in said canister between said walls and said elements retaining said elements in compression, and wall inlet means and outlet means defined respectively by inlet and outlet openings in said side wall, said openings surrounded by radially inwardly-turned wall lips, said lips protecting said pad means from erosion by exhaust gas at said openings.

12. The trap of claim 11 further comprising layers of said pad means between adjacent said elements and between said elements and said canister end walls.

13. The trap of claim 11 in which said elements comprise a body of open cell construction, and means on said body at said outlet surfaces thereof defining a layer of said material having a substantially smaller cell structure than that of the remainder of said body.

14. The trap of claim 11 further comprising a plenum chamber associated with said canister side wall and joining with said inlet openings, means in said plenum chamber forming a plurality of partitions dividing said chamber into a plurality of discrete passages leading to certain ones of said inlet openings, and diverter means for applying regeneration gases selectively to one of said passages at a time while providing for flow of exhaust gases to the remainder of said passages.

15. The trap of claim 14 in which said diverter means comprises a diverter nozzle, said nozzle having an inlet and an outlet, said nozzle inlet connected to a source of regeneration gases, said nozzle outlet being movable selectively into communication with one of said plenum chamber passages.

16. The trap of claim 15 in which said nozzle is movable to an inoperative storage position when regeneration is not required.

17. A trap element specifically for use in a cross flow diesel exhaust gas particulate trap, comprising a generally disc-shaped body formed of open-cell ceramic and having a pair of opposite axial faces, said body having means on one axial face thereof defining an inlet surface and means on an opposite axial face thereof defining an outlet surface, said body further having a partially surrounding peripheral wall extending axially by an amount which exceeds the thickness of said elements are measured between said faces, said peripheral wall at said inlet face defining a gap forming a gas inlet, and said peripheral wall further having a gap at said outlet face forming a gas outlet.

18. The element of claim 17 in which said element at said outlet surface is formed with a membrane layer having a pore size of substantially smaller size than that of the remainder of said body.

19. The element of claim 17 in which said surfaces are corrugated to increase the effective areas thereof.

20. The element of claim 17 in which said gaps are positioned generally at diametric opposite sides of said body.

21. The element of claim 20 further including strengthening ribs extending transversely across said inlet and outlet surfaces from said wall to said gaps.

* * * * *